US006186118B1

(12) United States Patent
Spakowski

(10) Patent No.: US 6,186,118 B1
(45) Date of Patent: Feb. 13, 2001

(54) INTEGRATED FUEL RAIL AND DIRECT INJECTION FUEL PUMP

(75) Inventor: Joseph George Spakowski, Rochester, NY (US)

(73) Assignee: Delphi Technologies, Inc., Troy, MI (US)

( * ) Notice: Under 35 U.S.C. 154(b), the term of this patent shall be extended for 0 days.

(21) Appl. No.: 09/437,551

(22) Filed: Nov. 10, 1999

(51) Int. Cl.[7] ..... F02M 41/00; F04B 1/00

(52) U.S. Cl. ..... 123/452; 123/456; 123/449; 417/525; 417/549

(58) Field of Search ..... 123/456, 451, 123/452, 449; 417/525, 549, 552, 553, 404

(56) References Cited

U.S. PATENT DOCUMENTS 5,163,706 11/1992 Maguran, Jr. et al. .
5,238,372 * 8/1993 Morris ..... 417/393
5,249,933 * 10/1993 Moody ..... 417/404
5,282,645 2/1994 Spakowski et al. .

FOREIGN PATENT DOCUMENTS

WO 99/22135 * 5/1999 (WO) .

* cited by examiner

*Primary Examiner*—Henry C. Yuen
*Assistant Examiner*—Arnold Castro
(74) *Attorney, Agent, or Firm*—John A. VanOphem

(57) ABSTRACT

A vehicle fuel system has an integrated fuel rail and fuel pump that supplies high pressure fuel directly to the injectors mounted on the engine. The pump is a double acting single piston pump that has two pumping chambers formed co-axially in a single cavity. One pumping chamber is twice the size of the other pumping chamber thereby producing an output flow equal to one half the volume of the larger pumping chamber during each stroke. The smaller pumping chamber communicates with a co-axial fuel rail portion of the cavity. A plurality of outlet ports, one for each injector, are disposed in fluid communication with the fuel rail portion of the cavity.

4 Claims, 1 Drawing Sheet

INTEGRATED FUEL RAIL AND DIRECT INJECTION FUEL PUMP

TECHNICAL FIELD

This invention relates to fuel systems for supplying fuel at elevated pressures to an internal combustion engine.

BACKGROUND OF THE INVENTION

Some modern vehicles employ a high pressure fuel injection system to improve the efficiency and operation of the engine. These systems include an intank supply pump and a high pressure pump that supplies fuel at an elevated pressure to a fuel rail. The fuel rail distributes the high pressure fuel to fuel injectors mounted either directly at the combustion chamber the.

The supply pump is generally located in a fuel tank and the high pressure pump is situated on the engine at a distance from the fuel rail. Thus the high pressure fuel has some distance to travel at an elevated pressure between the high pressure pump and the injectors. Since most fuel pumps displace more fuel than is needed by the engine, a fuel return is necessary. The fuel return may be by way of a regulator valve at the high pressure pump to the engine.

In some fuel systems, a continuous flow rotary type pump is used and in other systems, a single acting reciprocating pump is used. The reciprocating pump has a plunger that draws fluid into a cylinder when stroked in one direction and expels fluid from the cylinder when stroked in the other direction. Thus the pump delivers a single charge of fuel during each stroking cycle. Systems using either type of pump still utilize a fuel rail for distributing fuel to the individual injectors on the engine.

SUMMARY OF THE INVENTION

It is an object of the present invention to provide an improved fuel rail and fuel pump in a vehicle fuel supply system having a direct injection engine.

In one aspect of the present invention, a fuel pump and a fuel rail are integrated in a single assembly. In another aspect of the present invention, the fuel pump is a double acting single piston pump. In yet another aspect of the present invention, the fuel rail is incorporated into one of the pumping chambers of the double acting pump.

In still another aspect of the present invention, the fuel rail portion of the integrated assembly has an outlet port for each fuel injector in the fuel system. In a further aspect of the present invention, the pump has a large cylinder portion and a small cylinder portion with the large cylinder portion being connected with a fuel inlet port and a high pressure regulator having an outlet connected with a return fuel line. In yet a further aspect of the present invention, the pump piston has incorporated therein a valve assembly for controlling the flow of fuel between the cylinder portions and for relieving high pressure in the small cylinder portion.

The present invention provides a fuel system that incorporates a fuel pump directly into a fuel rail. The pump is a double acting piston pump having one piston. The pump is disposed in a housing that includes a cylindrical cavity in which the piston is disposed. A piston rod, attached to the piston, is also disposed in the cylindrical cavity. One side of the piston cooperates with the cylinder cavity to establish a first pumping chamber and the other side of the piston cooperates with the cylinder cavity and piston rod to establish a second chamber having a volume equal to one-half of the first chamber. Thus for each stroke of the piston, the pump produces an output flow substantially equal to the volume of the second chamber.

The second chamber has connected therewith a plurality of fuel outlet ports equal in number to the number of injectors on the engine. The second chamber, therefore, provides a fuel rail for the fuel system. The piston rod is driven by the engine or by an electric motor, at a speed commensurate with the engine speed, such that the pump output flow is proportional the speed of the engine.

The first chamber has an inlet port adapted to receive fuel from a fuel reservoir, and a system pressure regulator adapted to return excess fuel to the fuel reservoir. The piston has disposed thereon a plurality of control valves that control the flow of fuel between the chambers. dr

DESCRIPTION OF THE DRAWINGS

The drawing is a diagrammatic representation of a fuel system with a sectional elevational view of a fuel rail and pump incorporating the present invention.

DESCRIPTION OF THE PREFERRED EMBODIMENT

Figure 1:
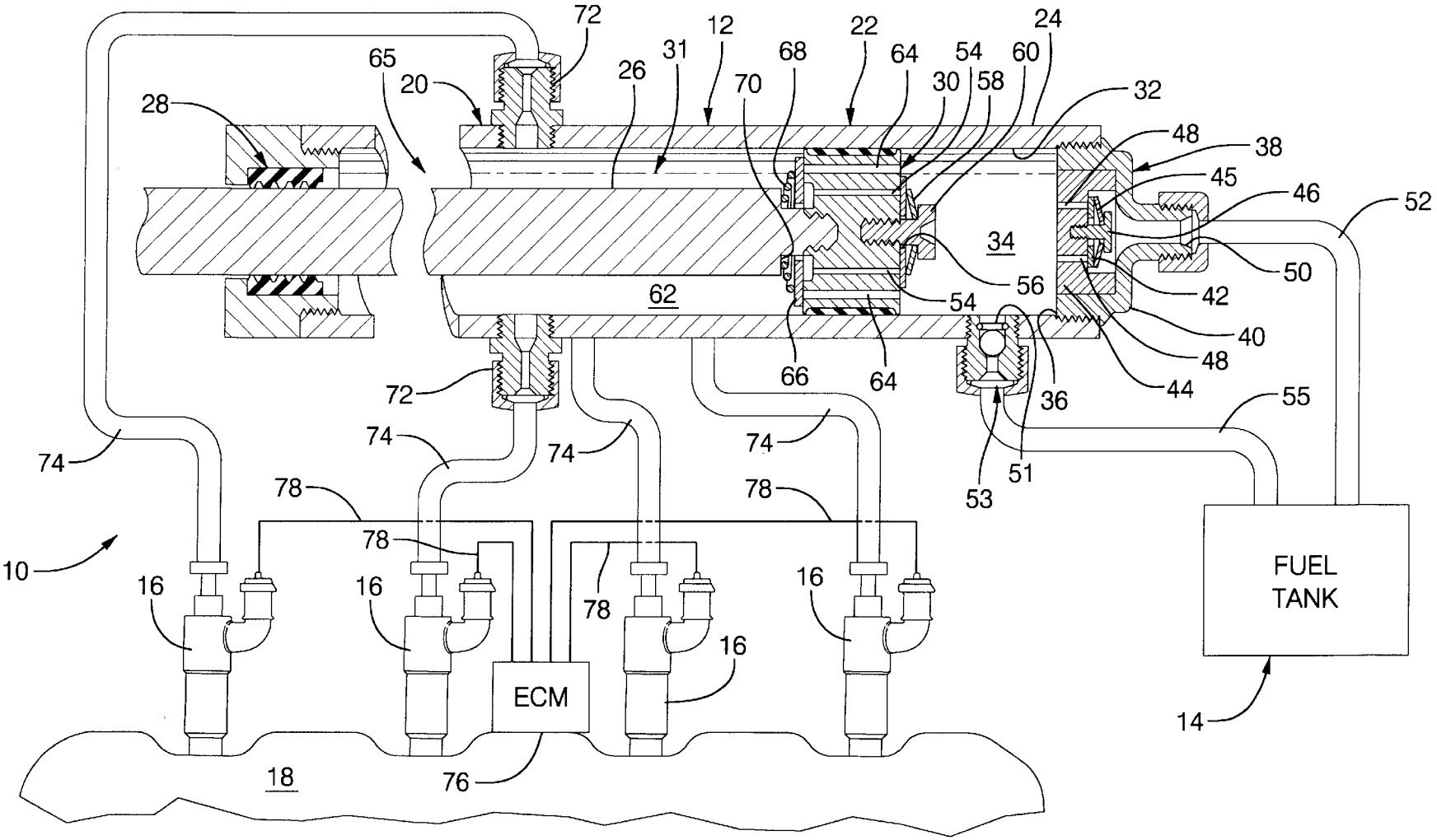

A fuel system 10 includes a fuel rail and pump 12, a fuel reservoir 14 and a plurality of fuel injectors 16. The fuel injectors 16 are adapted to deliver fuel to the cylinders of an engine 18 in a conventional manner. The fuel injectors are conventional fuel feed devices which deliver atomized fuel either directly into the combustion chamber of the engine or into the incoming air stream at the inlet valves of the engine. The fuel injection systems are well known in the art.

The fuel rail and pump 12 includes a fuel rail 20 and a fuel pump 22 both of which are enclosed in a housing 24. The pump 22 has a piston rod 26 that extends through the left end of the housing 24 as viewed in the drawing. A seal and bushing assembly 28 is disposed in the housing 24 surrounding and supporting the piston rod 26 in the housing 24. The piston rod 26 is driven through a conventional mechanism, such as a gear and cam drive, by the engine 18. In the alternative, the piston rod 26 can be driven by a variable electric motor in a conventional manner. Other drive mechanisms are also possible and well within the known prior art.

The piston rod 26 is secured to a piston 30 that is slidably supported in a cavity 31 defined by an inner cylindrical wall 32 of the housing 24. The piston 30 is driven reciprocably in the housing 24 by the piston rod 26. The piston 30 and inner cylindrical wall 32 cooperate to form a pumping chamber 34 which is closed at the right end 36 by a valve assembly 38. The valve assembly 38 has a cap 40 is which is housed a valve 42 and valve plate 44. The valve 42 is held against a valve plate 44 by a Belleville spring 45 and a threaded fastener 46. The valve 42 is an annular member comprised of a solid flexible material. The valve 42 overlaps passages 48 in the plate 44. The valve 42 is effective to normally close the passages 48 from communication with a fuel return port 50 that is connected to return fuel to the reservoir 14 though a conduit 52. The chamber 34 has an inlet port 51 that is in controlled fluid communication with the fuel reservoir 14 through a conventional inlet check valve assembly 53 and a conduit 55.

The piston has a plurality of passages 54 that are closed by a valve 56 that is urge to close the passages 54 by a Belleville spring 58 and a fastener 60. The passages 54 communicate with a chamber 62 formed by the piston 30, the inner surface 32 and the assembly 28. The valve 56 controls communication between the chamber 62 and the chamber 34. When the pressure in the chamber 62 exceeds the pressure set by the valve 56, fuel will flow through the passages 54 to the chamber 34.

The chamber 62 has one-half the crossectional area of the chamber 34. This is due to the fact that the rod 26 also has a crossectional area equal to one-half of the area of the chamber 34. The leftmost end 65 of the chamber 62 is incorporated into the fuel rail 20. The piston 30 also has a plurality of passages 64 that provide controlled fluid communication between the chambers 34 and 62. The passages 64 are closed by a valve 66 and a spring 68 that is trapped between a shoulder 70 on the rod 26 and the valve 66. The valve 66 will open under very slight pressure to permit fuel to flow from the chamber 34 to the chamber 62 but will close to prevent reverse flow of the fuel. However as described above, the valve 56 will permit flow from the chamber 62 to the chamber 34 when the pressure in the chamber 62 exceeds the setting of the valve 56.

The fuel rail 20 has connected therewith a plurality of outlet ports 72. Each outlet port 72 is connected for fluid communication with respective fuel injectors 16 through conduits 74. The pressurized fuel in the fuel rail 20 is continuous fluid communication with the fuel injectors 16. However, as is well-known, the fuel injectors 16 only expel fluid to the engine 18 when commanded by a conventional electronic control module (ECM) 76 which includes a conventional programmable digital computer, not shown. The ECM 76 is connected with each of the fuel injectors 16 by wires or electrical conduits 78.

As the piston 30 is stroked rightward in the housing 24, the volume of the chamber 34 decreases and the volume of the chamber 62 increases. However, the volume of the chamber 34 decreases at twice the rate at which the volume of the chamber 62 increases. When the piston 30 is stroked rightward, a volume of fuel equal to one-half the volume decrease of the chamber 34 is displaced from the chamber 62 through the fuel rail 20 to the injectors 16. If the injectors 16 cannot accept all of the displaced fuel, the pressure in the chambers 34 and 62 will increase until the preset pressure limit of the valve 42 is overcome and the excess fuel is returned to the fuel reservoir through the conduit 52. The fluid in the chamber 34 passes to the chamber 62 through the passages 64 and the valve 66.

The volume of fuel displaced by the piston 30 from the chamber 34 is equal to the product of the area of chamber 34 and the length of the stroke of the piston 30. The volume of fuel displaced by from the chamber 62 is equal to the product of the area a chamber 62 and the length of the stroke of the piston 30. Obviously the piston 30 displaces twice as much fuel, from the chamber 34, during a rightward stroke than the chamber 62 can accommodate. Thus half of the pumped volume must be distributed by the fuel rail 20 or returned to the reservoir 14 through the valve 42. During a leftward stroke of the piston 30, the same volume of fuel is displaced by the piston 30 through the fuel rail 20 or the valves 56 and 42.

As the piston 30 is stroked leftward, the displaced volume of fuel in the chamber 62 is delivered from the fuel rail 20 to the injectors 16 and the chamber 34 is filled through the check valve assembly 53 from the reservoir 14. The valves 66 and 56 prevent the fuel in the chamber 62 from flowing into the chamber 34 unless the injectors are satisfied and the preset pressure limit of the valve 56 is overcome. If the valve 56 opens, due to high pressure, the fuel in excess of what the injectors can use is returned to the chamber through the valve 56. Since the volume of the chamber 62 is only one-half the volume of the chamber 34, when the fuel is bypassed through the valve 56 the chamber 34 will still need half the volume made up from the reservoir plus the portion of the other half volume that is distributed by the fuel rail 20 to the injectors 16.

The fuel rail and pump 12 provides a compact and efficient package for delivering fuel to the injectors of a fuel injected engine. the number of outlet ports 72 that are employed by the fuel rail 20 is determined by the number of injectors 16 that are positioned on the engine. Generally there is one injector per cylinder. Thus, is a six cylinder engine is used, six outlet ports 72 will be incorporated at the fuel rail 20. The outlet ports 72 are shown as being radially positioned about the fuel rail 20. However, it will be apparent that the end 65 can be enlarged radially to permit axial disposition of the outlet ports 72 without affecting the operation of the fuel rail and pump 12.

What is claimed is:

1. A fuel rail and pump comprising:

a housing having a cylindrical cavity with a fluid inlet port;

a piston having a crossectional area and being slidably disposed in said cavity;

a rod secured with said piston and extending through one end of said cavity, said rod having a crossectional area substantially equal to one-half the crossectional area of said piston;

a first chamber formed in said cavity between said piston and another end of said cavity in fluid communication with said inlet port;

a second chamber formed in said cavity between said piston and said one end and enclosing a portion of said rod;

a fuel rail surrounding a portion of said rod in said cavity adjacent said second chamber, said fuel rail having a plurality of fluid outlet ports disposed in fluid communication with said second chamber and being connected with respective fuel injectors of an internal combustion engine;

means for reciprocating said rod; and valve mechanisms secured on said piston for controlling fluid flow between said first chamber and said second chamber during reciprocation of said rod.

2. The fuel rail and pump defined in claim 1 further comprising:

a regulator valve assembly secured at said other end of said cavity to relieve pressure in said cavity at a predetermined pressure level.

3. The fuel rail and pump defined in claim 1 further comprising:

said valve mechanisms comprising a first valve assembly positioned to permit fluid flow from said first chamber to said second chamber when said rod is reciprocated in a first direction and to restrict fluid flow from said second chamber to said first chamber when said rod is reciprocated in a second direction, and a second valve assembly positioned to prevent fluid flow from said first chamber to said second chamber when said rod is reciprocated in said first direction and to permit fluid flow from said second chamber to said first chamber when the fluid pressure level in said second chamber exceeds a predetermined value.

4. A fuel rail and pump comprising:

a housing having a cavity formed therein defining a first space for a reciprocating pump and a second space for a fuel rail and including a fuel inlet port communicating with said first space, said cavity having a first crossectional area, said first and second spaces being co-axially aligned;

said pump including a piston cooperating with said cavity to form a first chamber communicating with said fuel inlet port and a rod secured with said piston and being reciprocably mounted in said housing and cooperating with said cavity and piston to form a second chamber having a second crossectional area substantially equal to one-half said first crossectional area, said pump being effective during reciprocation to supply fuel from said fuel inlet port to said fuel rail independent of the direction of reciprocation;

said fuel rail being disposed in said cavity adjacent said second chamber and comprising a plurality of fuel outlet ports each adapted to be connected with a respective fuel injector; and valve means associated with said pump for controlling fluid flow between said fuel inlet port and said fuel outlet ports during reciprocation of said piston in said cavity, said valve means being effective to prevent fuel flow from said second chamber to said first chamber unless a pressure level in said fluid exceeds a predetermined value.

* * * * *